United States Patent [19]

Coiner et al.

[11] Patent Number: 4,537,463

[45] Date of Patent: Aug. 27, 1985

[54] SPRING CONTACT HOLDING SHELL HAVING INTEGRAL WIRE WRAP POST

[75] Inventors: Russell E. Coiner, Staunton; Thomas W. Moore, Fisherville, both of Va.

[73] Assignee: Virginia Panel Corporation, Waynesboro, Va.

[21] Appl. No.: 625,206

[22] Filed: Jun. 27, 1984

[51] Int. Cl.[3] ..... H01R 4/14

[52] U.S. Cl. ..... 339/276 A

[58] Field of Search ..... 339/276 A, 258 R, 258 C, 339/256 R, 17 R, 17 C, 276 SF

[56] References Cited

U.S. PATENT DOCUMENTS 3,371,152 2/1968 Damiano ..... 339/276 A X 3,748,634 7/1973 Barnes et al. ..... 339/276 A X

*Primary Examiner*—Eugene F. Desmond

*Attorney, Agent, or Firm*—B. P. Fishburne, Jr.

[57] ABSTRACT

An integral holding shell and wire wrap post for spring contacts is disclosed wherein the unitary product is formed by metal drawing operations instead of by separate machining and crimping operations previously carried out to connect the post to the holding shell. The product is gas-tight for a positive seal when used in vacuum test fixtures. Mechanical connections between the wire wrap post holding shell are eliminated, making the product more electrically sound. Manufacturing cost is reduced.

1 Claim, 9 Drawing Figures

SPRING CONTACT HOLDING SHELL HAVING INTEGRAL WIRE WRAP POST

BACKGROUND OF THE INVENTION

In the prior art, the holding shell and wire wrap post for spring contact probes and the like are commonly made separately and joined in a mechanical assembly operation. The wire wrap post in the prior art is formed by machining on a screw machine while the holding shell is produced by crimping and drawing operations. and then joined to a cylindrical head of the post by an assembly crimping process. The prior art product is somewhat costly to make and is not completely gas-tight, interfering somewhat with its use in vacuum test fixtures. In some cases, the product is not completely sound electrically, because of the mechanical connection of the separately formed wired wrap post with the holding shell.

The object of the present invention is to eliminate the above drawbacks of the prior art by providing an integrated holding shell and wire wrap post formed entirely by metal forming and drawing operations, thereby entirely eliminating machining of any part of the product. The integrated product, according to the invention, is completely gas-tight, enhancing its use in a vacuum environment, and is more electrically sound, due to the total elimination of the mechanical crimped connection between the shell and post according to the prior art. Furthermore, the manufacturing cost according to the present invention is reduced.

Other feature and advantages of the invention will become apparent to those skilled in the art during the course of the following description.

DETAILED DESCRIPTION

Figures 1, 2, 3, 4, 5, 6, 7, 8, 9:
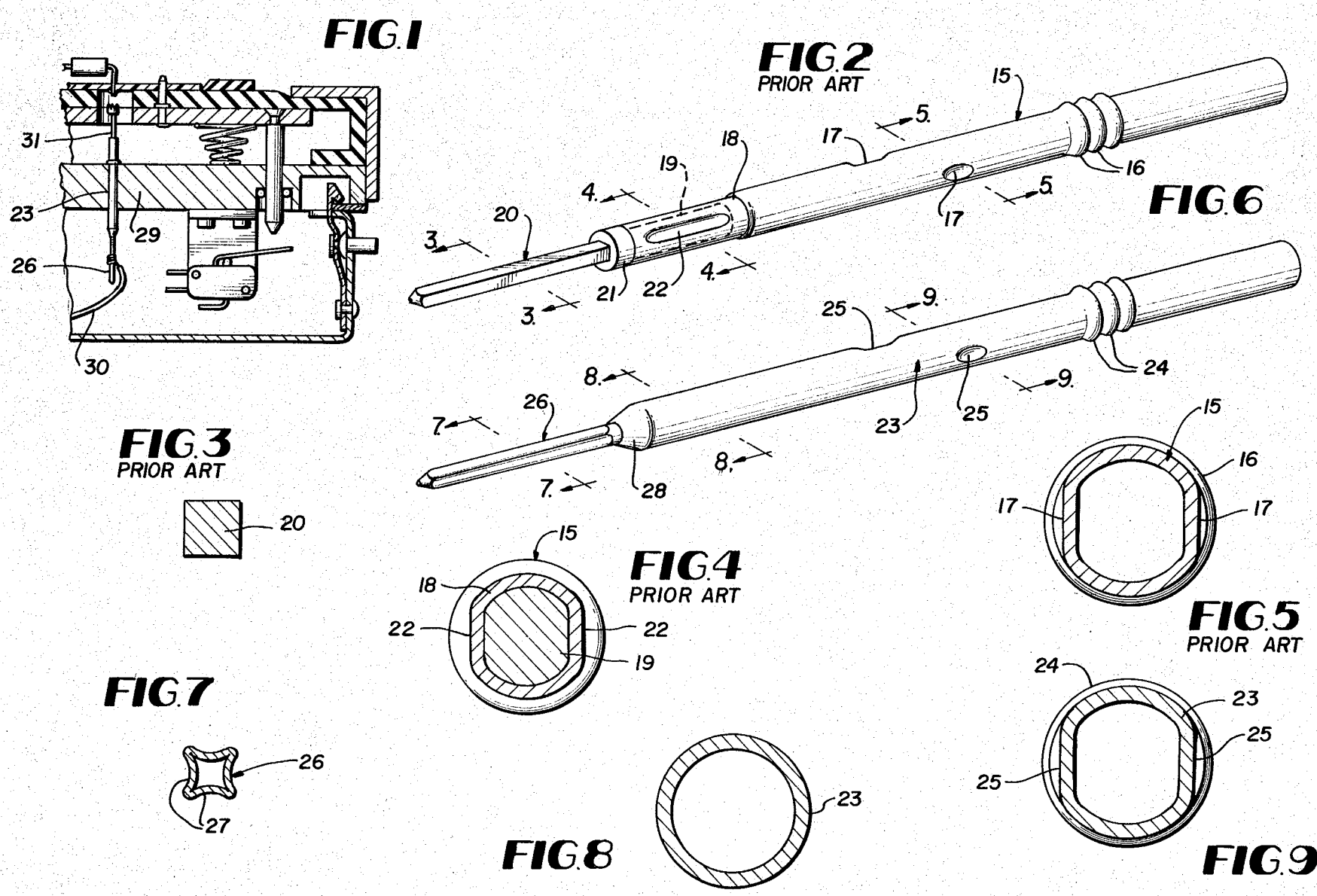
FIG.2 PRIOR ART
FIG.3 PRIOR ART
FIG.4 PRIOR ART
FIG.5 PRIOR ART
FIG. 1 is a fragmentary vertical section through a vacuum test fixture depicting one possible environment of the improved product according to the present invention.
FIG. 2 is a perspective view of an assembled holding shell and wire wrap post according to the prior art.
FIGS. 3, 4 and 5 are transverse cross sections taken through the prior art product on lines 3—3, 4—4 and 5—5 of FIG. 2.
FIG. 6 is a perspective view of an integrated holding shell and wire wrap post according to the present invention.
FIGS. 7, 8 and 9 are transverse sections taken through the integrated product on lines 7—7, 8—8 and 9—9 of FIG. 6.

Referring to the drawings in detail, wherein like numerals designate like parts, a prior art holding shell and wire wrap post assembly is shown in FIG. 2. This assembly comprises a tubular holding shell 15, customarily formed of phosphor-bronze. The holding shell is formed to provide one or more press rings 16 thereon and is crimped at longitudinally and circumferentially spaced locations, as indicated at 17. The holding shell is further worked to provide a somewhat reduced diameter forward extension 18 within which is received a cylindrical rear portion 19 of a solid square cross section wire wrap post 20 also formed of phosphor-bronze. The wire wrap post also includes a cylindrical shoulder 21 between its elements 19 and 20 which abuts the forward end of reduced diameter extension 18.

The wire wrap post 20 is produced in a screw machine in the prior art and is thus an entirely separate part. It is subsequently permanently assembled with the holding shell 15 by inserting the rear cylindrical portion 19 of the wire wrap post into the extension 18 and then crimping the extension 18 as at 22 at two or more locations around the circumference of the product. This crimping operation completes the mechanical joint between the holding shell 15 and wire wrap post 20.

The product in accordance with the present invention, FIGS. 6 through 9, is a one-piece or integral product without the necessity for separately producing the holding shell and wire wrap post, as described in connection with the prior art. No machining in a screw machine or the like is required.

A holding shell 23 according to the invention formed of phosphor-bronze tubing is worked to provide press rings 24 and spaced conventional crimps 25 substantially as in the prior art. The tubing employed to make the holding shell 23 is then subjected to drawing operations to form on the leading end of the shell an integral hollow wire wrap post 26 which, while generally rectangular, includes somewhat concave side walls 27, as best shown in FIG. 7. The drawing operation forming the wire wrap post 26 produces a short conically tapered transition area 28 on the product between the holding shell and the hollow wire wrap post 26. The separately formed wire wrap post in the prior art and the mechanical crimped connection between the post and holding shell are entirely eliminated by the invention and a greatly superior product, as well as a less expensive product, is achieved.

As previously noted, the absence of a mechanical joint between the wire wrap post 26 and holding shell 23 renders the assembly gas-tight and electrically sound in all cases. This is very important particularly where the improved product is employed in a vacuum test fixture, as indicated in FIG. 1. In this environment, the holding shell 23 is pressed through an aperture formed in a panel 29 and a wire 30 is wrapped on the post 26, as shown. A spring contact element 31 is placed within the open end of the holding shell 23, as indicated, in accordance with well-known practice. The improved product can be used in other environments, as is well known in the art. Its several advantages over the prior art should now be readily apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A unitary holding shell and wire wrap post comprising an elongated cylindrical tubular holding shell body portion having an open rear end, said holding shell body portion being provided somewhat forwardly of its open rear end with press rings projecting somewhat beyond the periphery of the holding shell body portion, an integral forward end coaxial reduced cross sectional size wire wrap post on the holding shell body portion and being elongated, a comparatively short conically tapered transition portion joining the rear of the wire wrap post to the forward end of the holding shell body portion, and the wire wrap post being hollow and approximately square in cross section and having four concave side walls forming four pronounced closed corners on the wire wrap post extending substantially for its entire length.

* * * * *